US008873217B2

(12) United States Patent
Hierl et al.

(10) Patent No.: US 8,873,217 B2
(45) Date of Patent: Oct. 28, 2014

(54) ARRANGEMENT FOR IGNITING SPARK GAPS

(75) Inventors: Stephan Hierl, Neumarkt/Opf. (DE); Michael Waffler, Neumarkt/Opf. (DE); Uwe Strangfeld, Nürnberg (DE); Arnd Ehrhardt, Neumarkt/Opf. (DE); Stefanie Schreiter, Neumarkt/Opf. (DE); Steffen Beier, legal representative, Neumarkt/Opf. (DE)

(73) Assignee: Dehn + Söhne GmbH + Co. KG, Neumarkt/Opf. (DE)

( * ) Notice: Subject to any disclaimer, the term of this patent is extended or adjusted under 35 U.S.C. 154(b) by 118 days.

(21) Appl. No.: 13/817,211

(22) PCT Filed: Jul. 13, 2011

(86) PCT No.: PCT/EP2011/061914

§ 371 (c)(1),
(2), (4) Date: Sep. 27, 2013

(87) PCT Pub. No.: WO2012/022547

PCT Pub. Date: Feb. 23, 2012

(65) Prior Publication Data

US 2014/0160614 A1 Jun. 12, 2014

(30) Foreign Application Priority Data

Aug. 17, 2010 (DE) ..... 10 2010 034 586 A
May 31, 2011 (DE) ..... 10 2011 102 937 A

(51) Int. Cl.
*F23Q 3/00* (2006.01)
*H01T 2/02* (2006.01)

(52) U.S. Cl.
CPC ..... *H01T 2/02* (2013.01)
USPC ..... 361/257

(58) Field of Classification Search
USPC ..... 361/257
See application file for complete search history.

(56) References Cited

U.S. PATENT DOCUMENTS 4,054,813 A * 10/1977 Agnoux et al. ..... 313/325
6,788,519 B2 9/2004 Zahlmann et al. ..... 361/129

(Continued)

FOREIGN PATENT DOCUMENTS

DE 20020771 2/2001 ..... H01T 2/02
DE 10146728 4/2003 ..... H01T 4/10

(Continued)

OTHER PUBLICATIONS

The International Search Report, in English, dated Oct. 17, 2011, and the International Preliminary Report on Patentability with the Written Opinion of the International Searching Authority (in English), dated Feb. 19, 2013, issued from Applicant's corresponding PCT Application No. PCT/EP2011/061914, filed on Jul. 13, 2011, from the International Searching Authority of WIPO.

*Primary Examiner* — Ronald W Leja
(74) *Attorney, Agent, or Firm* — Gerald T. Bodner

(57) ABSTRACT

The invention relates to an arrangement for igniting spark gaps with a trigger electrode T which is located on or in one of the main electrodes H2 and is insulated with respect to this main electrode H2, wherein the trigger electrode T is electrically connected to one of the other main electrodes H1 by means of at least one voltage-switching or voltage-monitoring element and there is an air gap between the trigger electrode T and the other main electrode H1. According to the invention, the trigger electrode T forms a sandwich structure with an insulation section I and a layer which is composed of a material M with a lower conductivity than the material of one of the main electrodes, wherein this sandwich structure represents a layered dielectric with the order of a first partial capacitor $C_I$ with the dielectric of the insulation section I and a second partial capacitor $C_M$ with the material M as dielectric.

9 Claims, 3 Drawing Sheets

(56) References Cited

U.S. PATENT DOCUMENTS

| | | | | |
|---|---|---|---|---|
| 6,977,468 | B1 | 12/2005 | Baginski | 313/602 |
| 7,336,474 | B2 * | 2/2008 | Lerche et al. | 361/248 |
| 2014/0160614 | A1 * | 6/2014 | Hierl et al. | 361/257 |

FOREIGN PATENT DOCUMENTS

| | | | |
|---|---|---|---|
| DE | 10245144 | 1/2004 | H01T 2/02 |
| DE | 102004006988 | 6/2005 | H01T 2/02 |

* cited by examiner

ARRANGEMENT FOR IGNITING SPARK GAPS

The invention relates to an arrangement for the ignition of spark gaps, comprising a trigger electrode located on or in one of the main electrodes and insulated from this main electrode, wherein the trigger electrode is electrically connected to the other main electrode by at least one voltage-switching or voltage-monitoring element and an air gap is provided between the trigger electrode and the other main electrode, according to patent claim 1.

As far as their behavior is concerned a distinction is made between breakdown spark gaps and surface spark gaps. Spark gaps of this type may be triggered, but also non-triggered. Triggered spark gaps have at least one trigger electrode in addition to the main electrodes. The ignition of triggered spark gaps is carried out, for instance, by using an ignition transformer, resulting in a high response voltage of the correspondingly well insulated trigger electrode.

In one alternative it is possible to initiate the ignition without an ignition transformer by a special arrangement of the trigger electrode relative to the main electrode. Thus, a conductive connection between the trigger electrode and the main electrode is obtained in many cases.

As a matter of principle triggered spark gaps have a controllable response behavior.

In the spark gap assembly for diverting harmful interferences caused by overvoltages according to DE 200 20 771 U1, which is encapsulated in a pressure-tight manner, a trigger voltage can be applied directly by a conductive housing provided there to form a subsidiary spark gap in the discharge space. The main spark gap is then ignited between the main electrodes by means of the subsidiary spark gap. In addition, an ignition transformer is employed, which forms part of the trigger device.

However, the use of an ignition transformer requires considerable installation space. Moreover, the intensity of the ignition voltage generated in the ignition transformer on the secondary side depends on the current change di/dt on the primary side. If this current impulse is not sufficiently steep the voltage on the secondary side is not enough to ignite the spark gap through. This means that the overvoltage protection device remains inactive in spite of the generated overvoltage.

An alternative possibility for triggering spark gaps is the connection of the trigger electrode to one of the main electrodes. In this case no ignition transformer is required. According to these prior art solutions a sliding discharge is triggered during the ignition process between one main electrode and the trigger electrode, which reaches the other main electrode after some time.

Such a solution is disclosed in DE 101 46 728 B4. In this overvoltage protection device the series connection of a voltage switching element and an ignition element is connected to the two main electrodes. The response voltage of the voltage switching element is below the response voltage of the breakdown spark gap. There is a transition resistance at the contact point between the ignition element and the electrode associated with the ignition element. When the voltage switching element responds, initially a discharge current flows through the ignition element. This ignition element is configured such that discharges occur at the contact point on account of the transition resistance in the case of higher discharge currents, which discharges result in a pre-ionization of the contact area surrounding the contact point.

Trigger electrodes of this type are permanently in electrical contact with one of the two main electrodes. This means that there is no galvanic separation of the main potentials. For this reason a voltage switching component, e.g. in the form of a gas discharge means, has to be connected into the trigger circuit. A further development of the solution approaches proposing a trigger electrode that is in a direct electrically conductive contact with one or more main electrodes is described in DE 10 2004 006 988 A1 and DE 102 45 144 B3.

The overvoltage protection device based on a spark gap according to DE 10 2004 006 988 A1 comprises at least two main electrodes located in a pressure-tight housing and at least one auxiliary ignition electrode. A functional unit for reducing the response voltage of the spark gap is accommodated in the housing volume, which is connected to one of the main electrodes and to the auxiliary ignition electrode.

The functional unit for reducing the response voltage of the spark gap is formed of a series connection consisting of a voltage switching element, an impedance and an isolating gap, which is located outside the arc burning space. The isolating gap is formed by the distance between the auxiliary ignition electrode and the nearest main electrode. If an overvoltage exceeding the sum of the response voltages of the switching element and the isolating gap occurs a current flows from the first main electrode to the second main electrode, with the consequence that the arc bridging the isolating gap provides charge carriers for the immediate ionization of the isolating gap between the main electrodes.

The ignition device according to DE 102 45 144 B3 comprises an auxiliary electrode which is connected to an ignition device. This ignition device has a non-linear, temperature-dependent resistor with a positive temperature coefficient. The resistance increase of this temperature-dependent resistor controls the ignition behavior and quenching behavior when the spark gap is subjected to a load.

With the above-described spark gap including a trigger electrode the spark-over gap in the ignition area is minimized so that the ignition impulse of the power is weak. In practice, the length of the arc is therefore only some 1/10 millimeters. The ignition arc has to burn in the area of the ignition spark gap until the space between the main electrodes is fully ionized and the arc can spark over to the second main electrode. By this the trigger electrode is loaded for a very long time and with a high energy input. Also, there is the risk that the complete discharge current flows through the auxiliary ignition electrode for a relatively long time period during the ignition process, with the consequence that particularly burn-off-resistant and thus expensive materials have to be used. Ultimately, the voltage drop in the trigger branch with the voltage-switching and voltage-limiting elements provided there is, in many cases, so high that the maximum protection level required in practice cannot be realized.

Based on the foregoing it is therefore the object of the invention to provide a further developed arrangement for the ignition of spark gaps, comprising a trigger electrode located on or in one of the main electrodes and insulated from these main electrodes, wherein the response behavior should be predeterminable in a great range and cost-efficient materials can be used, without impairing the operational reliability and the long-term stability of a so equipped spark gap.

The solution to the object of the invention is achieved by an arrangement for the ignition of spark gaps according to the combination of features defined in patent claim 1. The dependent claims define at least useful embodiments and further developments.

Accordingly, there is provided an arrangement for the ignition of spark gaps, comprising a trigger electrode T located on or in one of the main electrodes H2 and insulated from this main electrode H2, wherein the trigger electrode T is electrically connected to the other main electrode H1 by at least one voltage-switching or voltage-monitoring element and an air gap is provided between the trigger electrode T and the other main electrode H1.

According to the invention the trigger electrode T forms a sandwich structure with an insulation section I and a layer made of a material M which has a lower conductivity than the material of one of the main electrodes H1, H2, the sandwich structure representing a layered dielectric in the series connection of a partial capacitance $C_I$ to the dielectric of the insulation section I and a second partial capacitance $C_M$ to the material M as the dielectric. The partial capacitances $C_I$ and $C_M$ should be chosen to be particularly small so that a sparking in the spark gap is obtained immediately.

In one embodiment of the invention the insulation section is formed as a thin foil layer or lacquer coat.

In a preferred embodiment of the invention the thickness of the insulation section only amounts to a few hundredths of millimeters.

The material M of the sandwich structure has a conductivity which is poorer multiple times than the material of one of the main electrodes and is made, for instance, of a plastic material having conductive particles, e.g. of carbon, or metallic particles.

According to the invention an extension of the ignition arc is obtained by the thickness of the layer of material M. Additionally or alternatively the material M may also be overlapping with respect to the adjacent layers so that the distance from the trigger electrode to the nearest main electrode is extended again and the number of the charge carriers of the ignition arc plasma is increased.

In this sense, the sandwich structure may have a stepped structure, wherein the trigger electrode T is followed by a broader insulation section I, and the latter by a layer made of material M which is, again, broader than the insulation section I.

This sandwich structure may also have a stepped symmetrical structure.

In a preferred technical embodiment the sandwich structure may be formed of a lacquer-insulated printed circuit board or comprise elements of such a circuit board. The circuit board may be a foil circuit board or a circuit board of a rigid carrier material.

The invention will be explained in more detail below by means of an embodiment and with the aid of figures.

Figure 1:
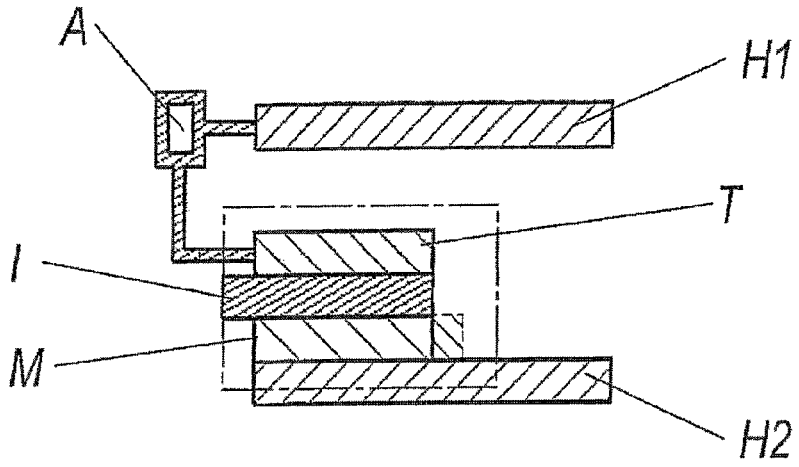
FIG. 1 shows a schematic diagram of the arrangement for the ignition of a spark gap, comprising two main electrodes and one trigger electrode.

The illustration shown in FIG. 1 shows two substantially opposite main electrodes H1 and H2 with an air dielectric located there between.

The strongly enlarged illustration of the ignition arrangement comprises an electrically conductive trigger electrode T which is covered by an insulation section I in the direction of the main electrode H2. The insulation section I is followed by a layer made of a material M with a small conductivity. The layer made of material M lies on the surface of the second main electrode H2.

A connection A allows the interconnection of external elements between the trigger electrode T and the main electrode H1. The means provided there can comprise, for instance, gas discharge means, varistors, diodes or similar elements.

The total arrangement according to the illustration of FIG. 1 is adapted to generate initially a breakdown or spark-over, respectively, between the trigger electrode T and the main electrode H2. A breakdown to main electrode H1 does not yet occur in this state. To ensure the aforementioned behavior an air gap is provided between the trigger electrode T and the surface of the main electrode H1. Of particular significance for the effect, especially for the fast response of the ignition device and thus the function of the spark gap is the distribution of the existing parasitic capacitances of the components taking part in the ignition process.

Figure 2:
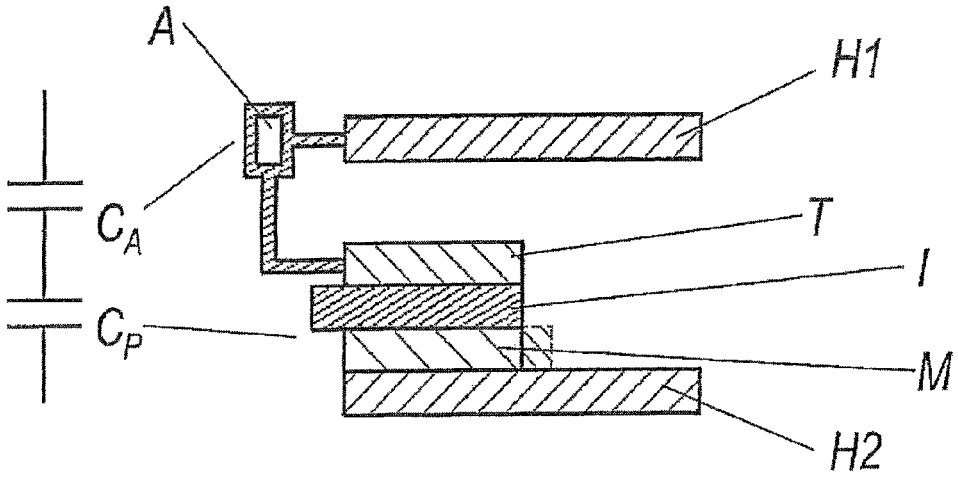
FIG. 2 shows an illustration of the resultant capacitive voltage divider of the arrangement of FIG. 1.

As is illustrated in FIG. 2 a capacitive voltage divider is obtained, which may initially be sub-divided into two main capacitances.

Capacitance $C_A$ for the triggering components in connection A and capacitance $C_P$ for the components of the actual ignition arrangement are connected in series.

Figure 3:
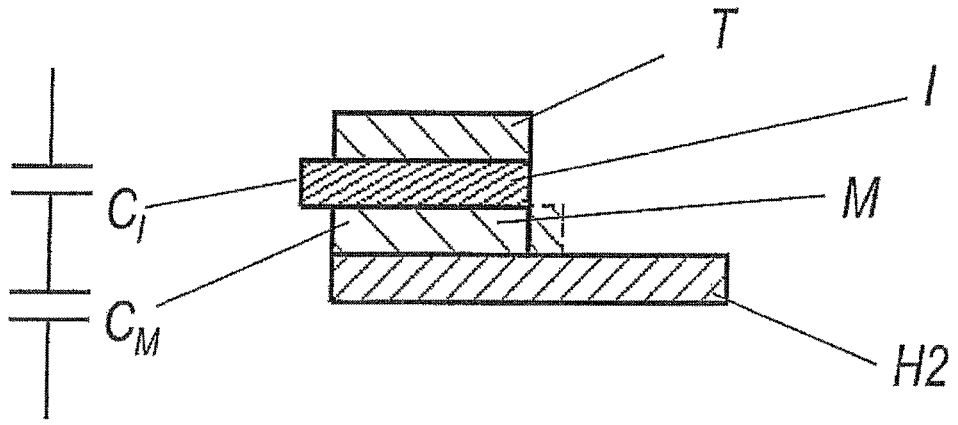
FIG. 3 shows an illustration of the layered dielectric of the ignition arrangement.

According to the illustration of FIG. 3 the ignition arrangement comprised of the insulation section I and the poorly conductive material M forms a layered dielectric, i.e. a dielectric made of materials which have different insulation resistances.

Thus, capacitance $C_P$ according to FIG. 2 is obtained from the series connection of partial capacitances $C_I$ and $C^M$ of FIG. 3.

Capacitance $C_A$ is greater than the partial capacitance $C_M$ or than the partial capacitance $C_I$. According to the invention the insulating layer is very thin. The thinner the layer thickness of the dielectric of the insulation section I the greater is the capacitance, and more voltage drops via $C_M$.

In the arrangement according to the invention, which can be paraphrased as plasma jet ignition, the insulating layer I is realized as a foil or lacquer coat on the trigger electrode T and, thus, can be very thin, preferably a few 1/100 millimeters. Accordingly, this insulating layer primarily determines the response behavior of the arrangement as a whole.

The choice of the material for layer M has a direct influence on the ignition rate and the behavior of the spark gap as a whole resulting therefrom.

Specifically, the thickness of the poorly conductive material M effects an extension of the ignition arc by extending the direct breakdown distance from the trigger electrode T to the main electrode H2.

As a result of the extension of the ignition arc a greater amount of arc plasma is injected into the electrode arrangement so that the spark-over between the main electrodes H1 and H2 can take place in a very short time.

The plasma jet is generated in the root point region of the arc on both electrodes. This jet results in a strong and fast target-oriented motion of ionized gases and charge carriers. According to the invention this transport may be used to significantly accelerate the ignition of the main gap between the electrodes H1 and H2, so that the load on the trigger electrode T, the layers I and M and also on the components in connection A is reduced and the residual voltage of the spark gap decreases.

The plasma jet effect is further characterized by obtaining a preferred direction of the ionized gas flow. According to the invention measures may be adopted which influence, on the one hand, the generation of the jet, and also the direction, so that the effect of a fast ignition of the main gap is obtained. The jet as proposed, with its very effective ionization of air distances, is particularly suited to bridge the air gap between H1 and H2, which results again in an effective operation of a horn gap.

Whereas in the prior art no plasma jets should preferably be generated after the ignition of the main electrodes for the pulsed arc to dwell, the formation of a targeted jet flow to ignite the main gap is desired in the present invention.

To obtain an effective plasma jet electrode materials are used which cool the arc well in the root point region. This supports the contraction of the root point of the arc. Strongly contracted root points are an optimal prerequisite for intensive plasma jets. A strong confinement of the propagation possibilities of the root point of the arc or of the arc as a whole, respectively, allows to influence the contraction and the dwell time of the arc. The strongly contracted root points of the arc allow a strong and selective alteration of the motion of the arc as a result of the self-magnetic forces.

The electrode arrangement and the intermediate layers I and M result in a preferred orientation of the plasma jets, which are otherwise very stochastic. The material choice also for the intermediate layers, e.g. suited for the release of gas, not only has an influence on the orientation of the plasma jet by the external flow then created, but it is possible to directly change the total flow intensity and the gas composition of the jet and the flow accompanying it.

In one embodiment the trigger electrode is made of a copper material, which effects a strong cooling of the root point. Thus, it is possible to realize the trigger electrode in very thin dimensions so that the root point diameter and the travel of the arc can be limited.

The layers I and M toward the electrodes T and H2 can be realized such that the material has an influence on the basic orientation possibilities and the gas flow of the plasma jet. Not only can the plasma jet be influenced, but it is also possible to vary the travel of the root point of the arc by the geometry. By the forced length of the ignition arc between T and H2 and, where appropriate, by a forced bending of the ignition arc into the desired direction by means of a step it is possible to use the thermal uplift and the self-magnetic action of force for the target-oriented widening of the arc or also for the target-oriented travel by motion of the root point after a corresponding dwell time.

As the plasma jets are generated on both electrodes intensive jets in short or angled arrangements result in a collision of the individual flows. If flows having similar intensities directly collide with each other on a common axis a so-called plasma plate is formed, which arches to a great extent toward both sides and ionizes the entire surroundings, i.e. also the gap to H2. If the axes are angular the jet flows try to flow past laterally side by side. However, this state is very unstable, so that the alternate direction constantly changes. If there is a lateral boundary by chamber walls this effect is intensified. Ultimately, a better and faster ionization of the gap is thus obtained as well.

Figure 4:
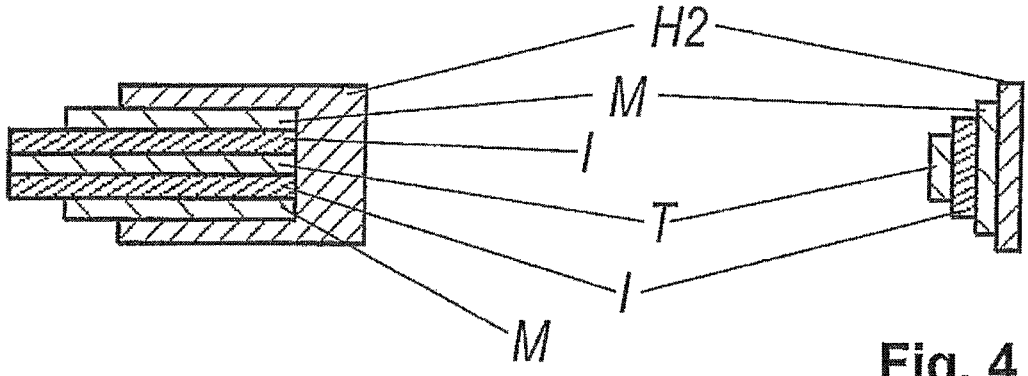
FIG. 4 shows a top view and a lateral view of a special geometry of the ignition arrangement with the desired extension of the ignition arc for injecting an intensified arc plasma into the electrode arrangement between the main electrodes.

As is shown schematically in FIG. 4 the effect and the formation of the ignition arc can be further intensified by varying the geometric embodiment.

In this case, not only the thickness of the layer formed of a poorly conductive material M is increased, but it is possible to form an overlapping layer or realize a stepped sandwich structure. Thus, the distance from the trigger electrode T to the main electrode is once more increased and the number of the charge carriers injected into the spark gap goes up. The illustration of FIG. 4 (top view) shows the sandwich structure and the stepped structure thereof. The actual trigger electrode T is laterally covered by the thin insulation section I, with a flush end on the front side. The layer made of the poorly conductive material M is then recessed in a step-like manner on the insulation section I.

The lateral view of FIG. 4 illustrates the step-like layer sequence consisting of main electrode H2, layer made of a poorly conductive material M, insulation section I and trigger electrode T. Embedding the trigger electrode T and the lateral boundary formed by the insulating layer material I is not an obligatory alternative of the further development of the ignition arrangement.

The thin insulation section I between the trigger electrode T and the layer made of a poorly conductive material M may preferably be realized by printed circuit boards. The trigger electrode T then corresponds to the applied conductor track and the insulating layer I to the coat of lacquer on top thereof. A portion on the end face remains free from the lacquer coat. The printed circuit board may be a flexible one with a foil carrier material, or it may be a rigid printed circuit board, wherein the printed circuit board carrier material may be the material with the poor conductivity.

With respect to the feature of a poorly conductive material it is noted that these should be materials whose current conductivity is worse than that of copper, e.g. conductive plastics or conductive ceramics. Ideally, a material having a high surface conductivity and a high volume resistivity is used. Materials having a high volume resistivity tend to have currents formed on the surface thereof rather than have the current flow through the volume. Due to the required small flexibility of the poorly conductive material a conductive plastic is used in one embodiment, whose electric resistance in the ignition area >10Ω and <100 kΩ. An optimal ignition effect is obtained with a resistance of 1 kΩ on a material thickness of 2/10 mm. The resistance value of this layer varies depending on the material used, wherein the length of the arc can be controlled by the thickness of the poorly conductive material.

Figure 5:
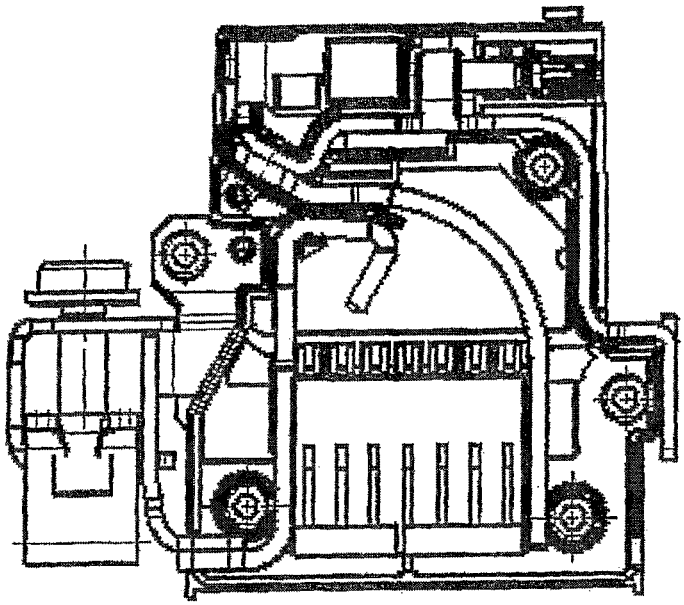
FIG. 5 shows an illustration of a realized embodiment of the arrangement according to the invention comprising horn-shaped main electrodes and a deionization chamber, shown without a cover part.
Figure 6:
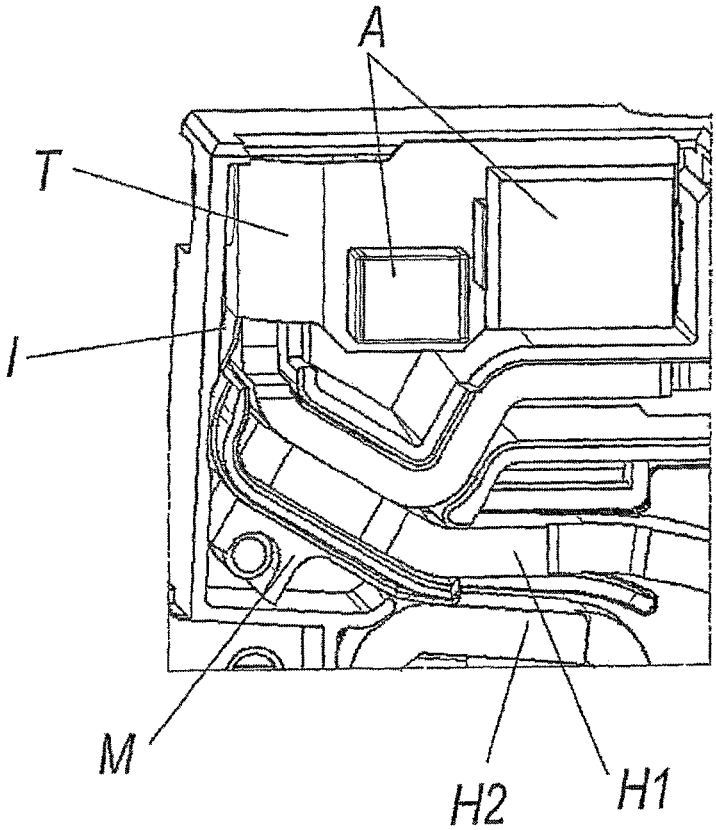
FIG. 6 shows a detailed illustration of the arrangement according to the invention for igniting a horn gap.

FIG. 5 shows a practically realized embodiment of the inventive solution with horn electrodes and a special ignition area, which is shown in detail in FIG. 6. Like elements or elements having like effects were designated with like reference numbers in the foregoing description.

What is claimed is:

1. Arrangement for the ignition of spark gaps, comprising a trigger electrode (T) located on or in one of the main electrodes (H2) and insulated from this main electrode (H2), wherein the trigger electrode (T) is electrically connected to the other main electrode (H1) by at least one voltage-switching or voltage-monitoring element and an air gap is provided between the trigger electrode (T) and the other main electrode (H1), characterized in that the trigger electrode (T) forms a sandwich structure with an insulation section (I) and a layer made of a material (M) which has a lower conductivity than the material of one of the main electrodes (H1, H2), the sandwich structure representing a layered dielectric in the series connection of a first partial capacitance (CI) to the dielectric of the insulation section (I) and a second partial capacitance (CM) to the material (M) as the dielectric, and the first partial capacitance (CI) and/or the second partial capacitance (CM) are chosen to be very small.

2. Arrangement according to claim 1, characterized in that the insulation section (I) is formed as a thin foil layer or lacquer coat.

3. Arrangement according to claim 2, characterized in that the thickness of the insulation section amounts to a few 1/100 mm.

4. Arrangement according to claim 1, characterized in that the material (M) has a conductivity which is poorer multiple times than the material of the main electrodes.

5. Arrangement according to claim 1, characterized in that the material (M) is made of a plastic material provided with conductive particles or fibers or of ceramics.

6. Arrangement according to claim 1, characterized in that an extension of the ignition arc is obtained by the thickness of the layer made of material (M).

7. Arrangement according to claim 1, characterized in that the sandwich structure has a stepped structure, wherein the trigger electrode (T) is followed by a broader insulation section (I), and the latter by a layer made of material (M) which is, again, broader than the insulation section (I).

8. Arrangement according to claim 7, characterized in that the sandwich structure has a stepped symmetrical or asymmetrical structure.

9. Arrangement according to claim 1, characterized in that the sandwich structure is formed of a lacquer-insulated printed circuit board.

* * * * *